US005975100A

United States Patent [19]

Sfeir

[11] Patent Number: 5,975,100

[45] Date of Patent: Nov. 2, 1999

[54] VIBRATIONAL WALKING APPARATUS

[76] Inventor: Jean Sfeir, 24 Long St., Huntington Station, N.Y. 11743

[21] Appl. No.: 09/031,734

[22] Filed: Feb. 27, 1998

[51] Int. Cl.[6] ..... A45B 3/00

[52] U.S. Cl. ..... 135/66; 135/911

[58] Field of Search ..... 135/65, 66, 68, 135/72, 76, 911

[56] References Cited

U.S. PATENT DOCUMENTS

| | | | |
|---|---|---|---|
| 2,791,762 | 5/1957 | Berry | 340/258 |
| 3,029,828 | 4/1962 | Kravitt | 135/85 X |
| 3,158,162 | 11/1964 | Reel | 135/85 X |
| 3,158,851 | 11/1964 | Ruthven | 340/258 |
| 3,251,371 | 5/1966 | Croker | 135/47 |
| 3,546,467 | 12/1970 | Benjamin, Jr. et al. | 250/215 |
| 3,996,950 | 12/1976 | Mier | 135/66 |
| 4,280,204 | 7/1981 | Elchinger | 367/116 |
| 4,559,962 | 12/1985 | Marchiano | 135/85 |
| 4,648,710 | 3/1987 | Ban et al. | 356/4 |
| 5,097,856 | 3/1992 | Chi-Sheng | 135/72 |
| 5,219,402 | 6/1993 | Kondo et al. | 135/911 X |

*Primary Examiner*—Lanna Mai

*Attorney, Agent, or Firm*—Mathews, Collins, Shepherd & Gould, P.A.

[57] ABSTRACT

The invention relates to a vibrational walking apparatus including a frame having flexible projections capable of detecting obstructions to the front or sides of the user. Width projections can extend laterally from the frame to detect a predetermined width of the user. The apparatus can include a height sensor to determine if an object will contact the upper extremities of the user. A vibrator located adjacent a handle is activated by switches coupled to the flexible projections and height sensor in order to provide a different vibrational frequency to the handle when one of the respective flexible projections or height sensor is activated.

7 Claims, 2 Drawing Sheets

VIBRATIONAL WALKING APPARATUS

BACKGROUND OF THE INVENTION

1. Field of the Invention

This invention relates to a vibrational walking apparatus for the visually impaired or visually and hearing impaired in which different vibrational frequencies are used to indicate an obstruction in the front at either side of the user or low-lying obstructions which might contact the user 2. Description of the Prior Art Conventionally, visually impaired persons have detected objects within their path by tapping the path at a short distance directly in front of the user's feet and occasionally to the right or left of the center of the course. Improvements have included canes with additional indication apparatus or sensing apparatus.

U.S. Pat. No. 3,251,371, describes a wheel mounting cane with laterally extending flexible arms positioned at the lower end of the cane to sense obstacles along and adjacent the cane path. Miniature bells located at the end of the arms on the cane are arranged to sound when the flexible arms contact any object on either side of the cane.

U.S. Pat. No. 3,158,162, describes a cane with feelers or detectors which transmit shock or vibration, attenuated by intervening springs disposed in the cane shaft. Whenever the detectors strike an obstruction during use of the cane, the shock of the impact induces mechanical vibration which travels through the cane to the handle. The above described patents have the shortcoming of not providing an indication as to which side of the cane was contacted by the object.

U.S. Pat. No. 3,158,851, describes a cane equipped with side projections of resilient construction. A handle includes a left and right handle portion to support respective right-side and left-side vibrators. The vibrators are connected with microswitches to respective right-side and left-side projections. The vibrators are electric buzzers which provide both audible and tactile signals. When an object is contacted, either the right or left side vibrator is activated to emit a buzzing sound. After hearing the buzzing sound, the user can spread his cane grasping hand to a both the right-side and left-side vibrators to determine which vibrator was activated. This patent has the drawback of being applicable only to persons who are not hearing impaired and of being cumbersome to operate.

U.S. Pat. No. 4,280,204, relates to a cane for the blind having an ultrasonic obstacle sensing apparatus for warning of low lying objects that might contact the upper extremities of a user or for warning of more remote objects. A transducer mounted on the shank portion of the cane transmits and receives a directional ultrasonic energy signal. In detecting remote objects, the cane is rotated about the longitudinal axis towards the object. An audible signal is routed to a set of earphones connected from the cane to the user. For detecting remote objects during movement of the user, the cane is rotated by the user towards the object while walking which maybe confusing to a visually impaired person. This patent is also limited to persons who are not hearing impaired.

SUMMARY OF THE INVENTION

Briefly described, the present invention relates to a vibrational walking apparatus in which different vibrations are generated in a handle for indicating that an obstruction is in front, to the right or left of the user or that an obstruction is in the path of the upper extremities of the user. An elongated frame includes a pair of flexible width projections extending laterally from the side to the frame. A front flexible projection extends laterally from the front of the frame. A switch is coupled from each of the projections to a vibrator located adjacent the handle. Contact of one of the flexible projections with an object generates a predetermined vibrational frequency in the vibrator for vibrating the handle at differing frequencies.

In one embodiment, the projections are formed of a spring extending from the frame attached to a respective switch. Alternatively, the projection can be a sensor. Preferably, the projections can be removable from the frame.

A height sensor can be coupled to the frame for generating a predetermined vibrational frequency when an object is lower than the upper extremities of the user. The vibrational frequency generated by the height sensor is different than the vibrational frequency generated by the width and front projections.

The frame can be telescopically adjustable to the height of the user or for ease of storing or carrying the apparatus when not in use. Reflectors can be coupled along the length of the frame for night safety.

In use, the flexible width projections generate different vibrational frequencies to the handle when the user approaches areas smaller than the user's shoulders. The front projection generates a different vibrational frequency to the handle when the user contacts an object in front of the user. A height sensor generates a different vibrational frequency to the handle when the user approaches an area shorter than the user's head.

The advantages and various additional features of the invention will appear more fully upon consideration of the illustrative embodiments now to be described in detail in connection with the accompanying drawings.

DETAILED DESCRIPTION OF THE INVENTION

During the course of this description like numbers will be used to identify like elements according to the different figures which illustrate the invention.

Figure 1:
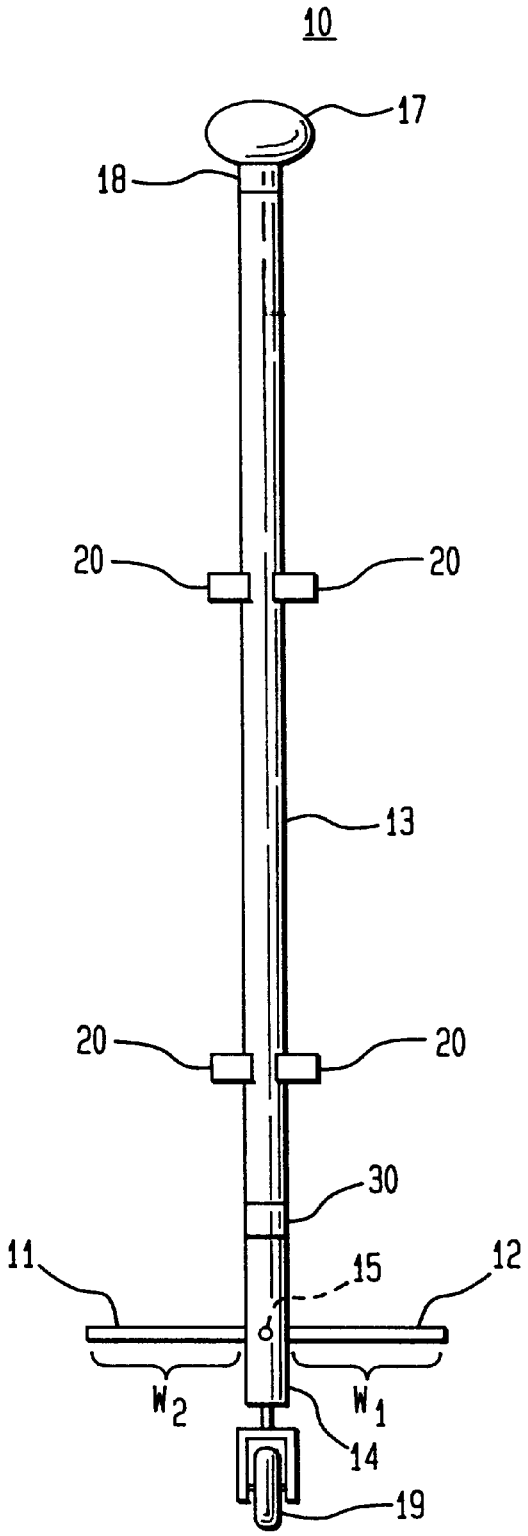
FIG. 1 is a front elevational view of a vibrational walking apparatus in accordance with the teachings of the present invention.
Figure 2:
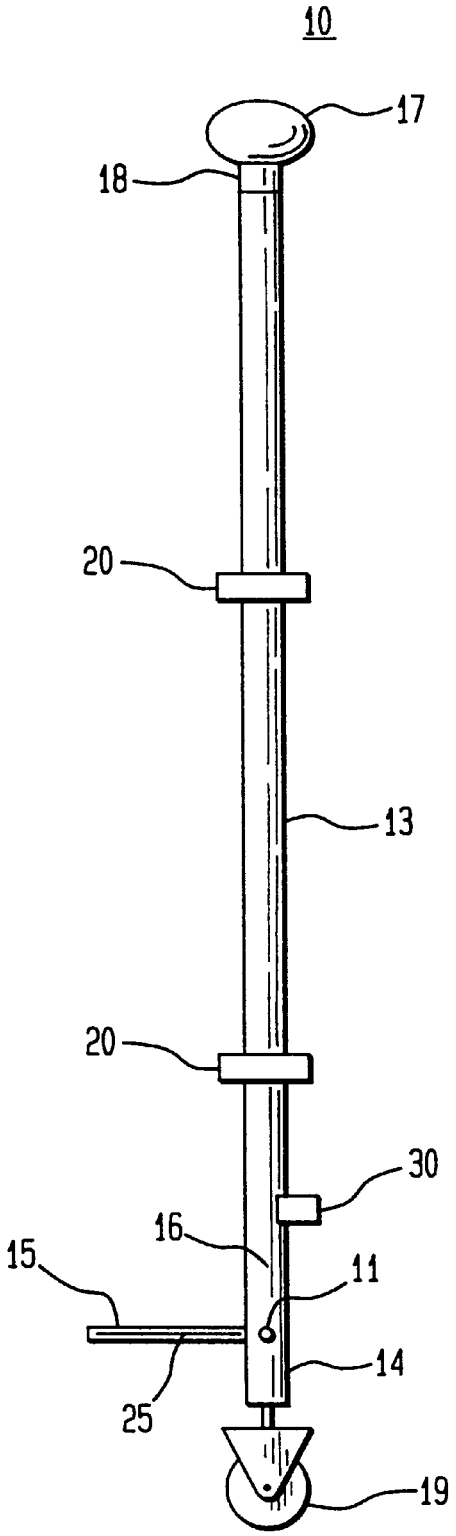
FIG. 2 is a side elevational view of a vibrational walking apparatus shown in FIG. 1.

FIG. 1 is a front elevational view of a vibrational walking apparatus 10 in accordance with the teachings of the present invention. A pair of flexible width projections, 11, 12 extend laterally from frame 13. Flexible width projections 11, 12 detect obstructions on either side of a user of vibrational walking apparatus 10. Flexible width projections 11, 12 can be positioned at the bottom 14 of frame 13. Preferably, flexible width projection 11, has a width w, and flexible width projection 12 has a width $W_2$ such that the combined width of $w_1$ and $w_2$ is about the width of the shoulders of a user when flexible width projections 11, 12 are attached to frame 13. Flexible front projection 15 can be positioned between flexible width projections 11, 12 at the front 16 of frame 13 as shown in FIG. 2.

Frame 13 can be adjusted for the height of the user. Frame 13 can be telescopically adjustable for increasing or decreasing the length of frame 13 for adjustment to the height of the user. The length of frame 13 can also be decreased to allow frame 13 to be easily carried and stored when not in use.

Vibrating handle 17 is positioned at top 18 of frame 13. Wheel 19 positioned at bottom 14 of frame 13 can be used to support frame 13. Reflectors 20 are coupled along the length of frame 13 for providing night safety.

Figure 3:
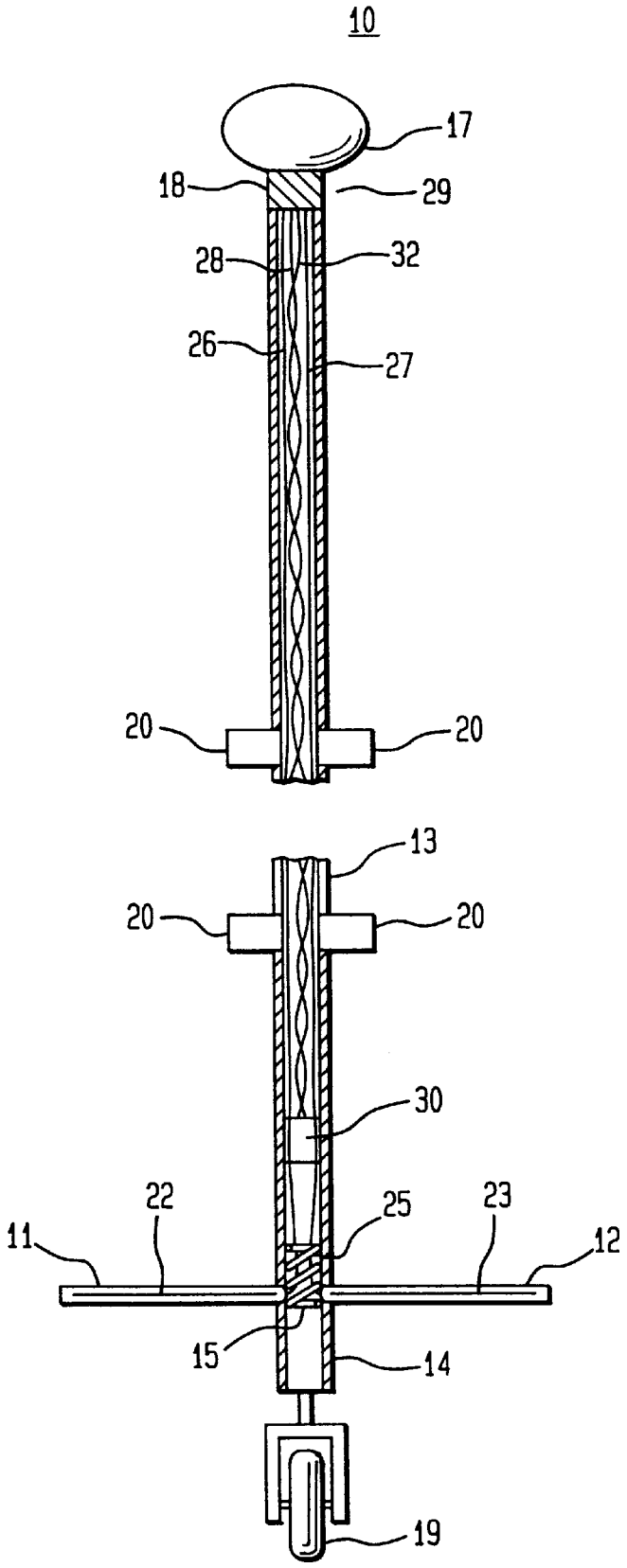
FIG. 3 is a cross-sectional view of the vibrational walking apparatus shown in FIG. 1.

Flexible width projections 11, 12 can be formed of respective springs 22 and 23, as shown in FIG. 3. Springs 22 and 23 are coupled with respective switches 26 and 27 to vibrator 29. Flexible front projection 15 is formed of spring 25. Spring 25 is coupled with switch 28 to vibrator 29. For example, a microswitch and spring assembly can be used as described in U.S. Pat. No. 3,158,851 hereby incorporated by reference into this application. Switches 26, 27 and 28 can be coupled to vibrator 29 with an electrical connection which in turn is coupled to an energy source (not shown). Vibrator 29 is positioned adjacent vibrating handle 17. Vibrator 29 generates varying vibrational frequencies, depending on which of switches 26, 27 or 28 is activated. For example, during use if flexible width projection 11 contacts an object, switch 26 activates vibrator 29 at a particular vibrational frequency such as a low vibrational frequency. Alternatively, if flexible width projection 12 contacts an object switch 27 activates vibrator 29 at a different vibrational frequency, such as a high vibrational frequency. If flexible front projection 15 detects an object switch 28 activates vibrator 29 at a different vibrational is frequency between the high vibrational frequency and the low vibrational frequency.

Alternatively, flexible width projections 11, 12 and flexible front projection 15 can be formed of a sensor for detecting objects at a predetermined distance from frame 13. The predetermined distance from the frame can be the width of the user. In this embodiment, flexible width projections 11, 12 can have a width which is narrower than the width of the user. For example, the sensor can include a light emitting element which converges on an object to be detected and a receiving element for receiving the light reflected by the object to activate respective switches 26, 27 or 28. It will be appreciated that other sensors can be used with the present invention, for example, as described in U.S. Pat. Nos. 3,546,467; 5,097,856; and 4,280,204, hereby incorporated by reference into this application.

Height sensor 30 can be attached to frame 13 between flexible width properties 11, 12. Height sensor 30 is focused upwardly of frame 13. Height sensor 30 can be adjusted to detect low lying objects which may contact the upper extremities of the user. Height sensor 30 can be coupled with switch 32 to vibrator 29. Switch 32 activates vibrator 29 at a different vibrational frequency than switches 26, 27 and 29.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

I claim:

1. A vibrational walking apparatus for use by visually impaired or visually and hearing impaired persons comprising:

an elongated frame;

a first and second flexible width projection coupled to said frame and; extending laterally from a first and second side of said frame;

a front flexible projection coupled to said frame extending laterally from the front of said frame;

a vibrational handle positioned at the top of said frame; and a vibrator coupled to said first and second width flexible projection, said front flexible projection and said vibrational handle, said vibrator providing a plurality of vibrational frequencies for vibrating said vibrational handle at differing frequencies, wherein a first one of said vibrational frequencies is generated when said first flexible width projection contacts an object, a second one of said vibrational frequencies is generated when said second flexible width projection contacts an object and a third of one said vibrational frequencies is generated when said front flexible projection contacts an object.

2. The apparatus of claim 1 further comprising:

a height sensor coupled to said frame, wherein a fourth one of said vibrational frequencies is generated when said height sensor senses an object.

3. The apparatus of claim 1 wherein said first and second flexible width projections and said front flexible projection are removable.

4. The apparatus of claim 1 wherein said frame is telescopically adjustable.

5. The apparatus of claim 1 wherein said first and second flexible width projection and said front projection are each formed of a spring coupled to a switch, said spring extending from said frame, said switch being coupled to said vibrator.

6. The apparatus of claim 1 wherein said first and second flexible width projection and said front flexible projection are formed of a sensor.

7. An apparatus of claim 1 further comprising reflectors coupled along the length of said frame.

* * * * *